US011735405B2

(12) United States Patent
Kubo et al.

(10) Patent No.: US 11,735,405 B2
(45) Date of Patent: Aug. 22, 2023

(54) MASS SPECTRUM PROCESSING APPARATUS AND METHOD

(71) Applicant: JEOL Ltd., Tokyo (JP)

(72) Inventors: Ayumi Kubo, Tokyo (JP); Masaaki Ubukata, Tokyo (JP)

(73) Assignee: JEOL Ltd., Tokyo (JP)

( * ) Notice: Subject to any disclaimer, the term of this patent is extended or adjusted under 35 U.S.C. 154(b) by 284 days.

(21) Appl. No.: 17/111,709

(22) Filed: Dec. 4, 2020

(65) Prior Publication Data

US 2021/0175060 A1 Jun. 10, 2021

(30) Foreign Application Priority Data

Dec. 6, 2019 (JP) ..... 2019-221008

(51) Int. Cl.
*H01J 49/00* (2006.01)

(52) U.S. Cl.
CPC ..... *H01J 49/0036* (2013.01); *H01J 49/0031* (2013.01)

(58) Field of Classification Search
CPC ..... H01J 49/0031; H01J 49/0036
See application file for complete search history.

(56) References Cited

U.S. PATENT DOCUMENTS

| | | | |
|---|---|---|---|
| 2010/0171032 | A1 | 7/2010 | Wang et al. |
| 2014/0379279 | A1 | 12/2014 | Pfaff |
| 2015/0221492 | A1 | 8/2015 | Solouki et al. |
| 2019/0172695 | A1 | 6/2019 | Nagatomo et al. |

FOREIGN PATENT DOCUMENTS

| | | | |
|---|---|---|---|
| JP | 3285158 | A | 12/1991 |
| JP | 1164285 | A | 3/1999 |
| JP | 200583952 | A | 3/2005 |
| JP | 2008298517 | A | 12/2008 |
| JP | 2017129534 | A | 7/2017 |
| JP | 2019100891 | A | 6/2019 |

OTHER PUBLICATIONS

Office Action issued in JP2019221008 dated Oct. 26, 2021.
Extended European Search Report issued in EP 20210770.2 dated Apr. 12, 2021.

*Primary Examiner* — David A Vanore

(57) ABSTRACT

Each estimated composition candidate is evaluated based on a mass spectrum produced using soft ionization and a mass spectrum produced using hard ionization. In the evaluation, a comparison between two measured isotope patterns (primary pattern matching), and a comparison between the measured isotope pattern and a theoretical isotope pattern (secondary pattern matching) are applied stepwise.

10 Claims, 13 Drawing Sheets

FIG. 8

132 134

| | | HARD IONIZATION | | | |
|---|---|---|---|---|---|
| | | $[M]^+$ NOT DETECTED | ONLY $[M]^+$ DETECTED | ONLY $[M-1]^+$ DETECTED | BOTH DETECTED |
| (REFERENCE) SOFT IONIZATION | $[M]^+$ NOT DETECTED | – (#00) | – (#10) | – (#20) | – (#30) |
| | ONLY $[M]^+$ DETECTED | MASS DIFFERENCE: OTHER THAN 0, 1, 2 COMPARISON: SUCCESSFUL (#01) | MASS DIFFERENCE: 0 PRIMARY COMPARISON: SUCCESSFUL SECONDARY COMPARISON: SUCCESSFUL (#11) | MASS DIFFERENCE: 1 PRIMARY COMPARISON: SUCCESSFUL SECONDARY COMPARISON: SUCCESSFUL (#21) | MASS DIFFERENCE: 0 PRIMARY COMPARISON: UNSUCCESSFUL SECONDARY COMPARION: SUCCESSFUL (SI) (#31) |
| | ONLY $[M+1]^+$ DETECTED | MASS DIFFERENCE: OTHER THAN 1, 1, 2 COMPARISON: SUCCESSFUL (#02) | MASS DIFFERENCE: 1 PRIMARY COMPARISON: SUCCESSFUL SECONDARY COMPARISON: SUCCESSFUL (#12) | MASS DIFFERENCE: 2 PRIMARY COMPARISON: SUCCESSFUL SECONDARY COMPARISON: SUCCESSFUL (#22) | MASS DIFFERENCE: 1 PRIMARY COMPARISON: UNSUCCESSFUL SECONDARY COMPARION: SUCCESSFUL (SI) (#32) |
| | BOTH DETECTED | MASS DIFFERENCE: OTHER THAN 0, 1, 2 COMPARISON: UNSUCCESSFUL USE OF FRAGMENT (#03) | MASS DIFFERENCE: 0 PRIMARY COMPARISON: UNSUCCESSFUL SECONDARY COMPARISON: SUCCESSFUL (HI) (#13) | MASS DIFFERENCE: 1 PRIMARY COMPARISON: UNSUCCESSFUL SECONDARY COMPARISON: SUCCESSFUL (HI) (#23) | MASS DIFFERENCE: 1 PRIMARY COMPARISON: UNSUCCESSFUL SECONDARY COMPARISON: UNSUCCESSFUL USE OF FRAGMENT (#33) |

130 136

FIG. 14

| 164 COMPOSITION CANDIDATE | F | 166 PARTIAL COMPOSITION CANDIDATE | 168 APPROPRIATENESS/IN APPROPRIATENESS OF SUBTRACTION RESULT | 170 ISOTOPE PATTERN COMPARISON | 172 EVALUATION |
|---|---|---|---|---|---|
| C18H8N4 | F1 | C4H4O2 | NUMBER OF O BEING NEGATIVE | — | NG |
| | F2 | C2H3O | NUMBER OF O BEING NEGATIVE | — | |
| | F3 | CH2 | APPROPRIATE | NON-MATCH | |
| C3H14N5O10 | F1 | C4H4O2 | NUMBER OF C BEING NEGATIVE | — | NG |
| | F2 | C2H3O | APPROPRIATE | NON-MATCH | |
| | F3 | CH2 | APPROPRIATE | NON-MATCH | |
| C4H10N9O6 | F1 | C4H4O2 | APPROPRIATE | NON-MATCH | NG |
| | F2 | C2H3O | APPROPRIATE | NON-MATCH | |
| | F3 | CH2 | APPROPRIATE | NON-MATCH | |
| C17H12O4 | F1 | C4H4O2 | APPROPRIATE | NON-MATCH | OK |
| | F2 | C2H3O | APPROPRIATE | MATCH | |
| | F3 | CH2 | APPROPRIATE | NON-MATCH | |

174 176

MASS SPECTRUM PROCESSING APPARATUS AND METHOD

CROSS REFERENCE TO RELATED APPLICATION

This application claims priority to Japanese Patent Application No. 2019-221008 filed Dec. 6, 2019, the disclosure of which is hereby incorporated by reference in its entirety.

BACKGROUND OF THE INVENTION

Field of the Disclosure

The present disclosure relates to a mass spectrum processing apparatus and method, and in particular to a technique for evaluating an estimated composition.

Description of Related Art

A mass spectrum processing apparatus has a function to estimate a composition of a sample (more accurately, a composition or computational formula). In the estimation of the composition, a molecular ion peak is selected on a mass spectrum by an analyzer or automatically. The composition of the sample is theoretically estimated based on a precise mass of the molecular ion peak. Normally, a plurality of composition candidates are estimated, and, among these candidates, probable composition candidates are narrowed down. As a method of narrowing down, there is known a method which uses an isotope pattern. In this method, an isotope pattern theoretically calculated from a composition candidate (theoretical isotope pattern) is matched to a molecular ion peak group in the mass spectrum (measured isotope pattern).

When the sample is an organic compound, due to the presence of isotopes, the molecular ions of the sample are in general constituted from first molecular ions having a smallest mass, second molecular ions which are heavier than the first molecular ions by 1 u, third molecular ions which are heavier than the first molecular ions by 2 u, . . . and the like. In correspondence to this, the molecular ion peak group in the mass spectrum are constituted from a first molecular ion peak, a second molecular ion peak, a third molecular ion peak, . . . and the like. In general, for molecules having molecular weights of 500 or smaller, the first molecular ion peak is a monoisotopic peak, and an intensity of the first molecular ion peak is the largest. For certain organic compounds, an intensity of the second or later molecular ion peak may be the largest.

As a soft ionization method, various ionization methods are known. For example, there are known a field ionization method (FI), a field desorption ionization method (FD), a photoionization method (PI), and the like. According to the soft ionization method, an isotope pattern of a molecular ion $[M]^+$ tends to be observed. With this observation, an isotope pattern of a molecular ion $[M+H]^+$ to which a proton is added may be observed. On the mass spectrum, an overlap exists between a first molecular ion peak of the molecular ion $[M+H]^+$ to which the proton is added and a second molecular ion peak (that is, a second isotope peak) of the molecular ion $[M]^+$ to which the proton is not added, and a peak occurs in which these peaks are added. In reality, such overlaps occur at a plurality of peak positions.

As a representative ionization method of a hard ionization method, there is known an electron impact ionization method (EI). When the hard ionization method is used, fragment ions are primarily observed. On the mass spectrum, an isotope pattern of the molecular ion $[M]^+$ may or may not appear. For certain organic compounds forming the sample, an isotope pattern of a molecular ion $[M-H]^+$ from which hydrogen is desorbed may be observed. In this case, on the mass spectrum, an overlap exists between a second molecular ion peak of the molecular ion $[M-H]^+$ from which hydrogen is desorbed, and a first molecular ion peak of the molecular ion $[M]^+$ from which hydrogen is not desorbed, and a peak occurs in which these peaks are added. In reality, such overlaps occur at a plurality of peak positions.

JP H3-285158 A discloses a mass analysis apparatus which can switch between the EI method and the CI method.

When the composition is to be evaluated or narrowed down based on the isotope pattern matching, if the isotope pattern of the molecular ion $[M+H]^+$ to which the proton is added and the isotope pattern of the molecular ion $[M-H]^+$ from which hydrogen is desorbed are detected at the same time with the isotope pattern of the molecular ion [M]+, the isotope pattern matching cannot be appropriately performed.

An advantage of the present disclosure lies in enabling correct composition evaluation using the isotope pattern matching, in a situation in which there is a possibility of detection of an isotope pattern of a molecular ion to which the proton is added or a possibility of detection of an isotope pattern of a molecular ion from which hydrogen is desorbed.

SUMMARY

According to one aspect of the present disclosure, there is provided a mass spectrum processing apparatus comprising: a composition estimator that estimates a composition based on at least one of a first monoisotopic peak included in a first peak group in a first mass spectrum produced through soft ionization of a sample, or a second monoisotopic peak included in a second peak group in a second mass spectrum produced through hard ionization of the sample; a primary pattern matching unit that attempts primary pattern matching between the first peak group and the second peak group; and a first secondary pattern matching unit that attempts, when the first pattern matching is successful, secondary pattern matching between a representative peak group which represents the first peak group and the second peak group, and an isotope pattern theoretically derived from the estimated composition, to thereby evaluate the estimated composition.

According to another aspect of the present disclosure, there is provided a method of processing a mass spectrum, comprising: a composition estimating step in which a composition is estimated based on at least one of a first monoisotopic peak included in a first peak group in a first mass spectrum produced through soft ionization of a sample, or a second monoisotopic peak included in a second peak group in a second mass spectrum produced through hard ionization of the sample; and a step of evaluating the estimated composition, wherein, in the step of evaluating, there are utilized primary pattern matching between the first peak group and the second peak group, and secondary pattern matching between a measured isotope pattern which is the first peak group or the second peak group, and a theoretical isotope pattern theoretically derived from the estimated composition.

BRIEF DESCRIPTION OF DRAWINGS

Embodiment(s) of the present disclosure will be described based on the following figures, wherein:

FIG. 8 is a diagram showing a relationship between a plurality of types of isotope patterns which may be included in an SI mass spectrum and a plurality of types of isotope patterns which may be included in an EI mass spectrum;

FIG. 14 is a diagram showing an evaluation method of a composition candidate using fragment ions.

DESCRIPTION OF THE DISCLOSURE

Figure 1:
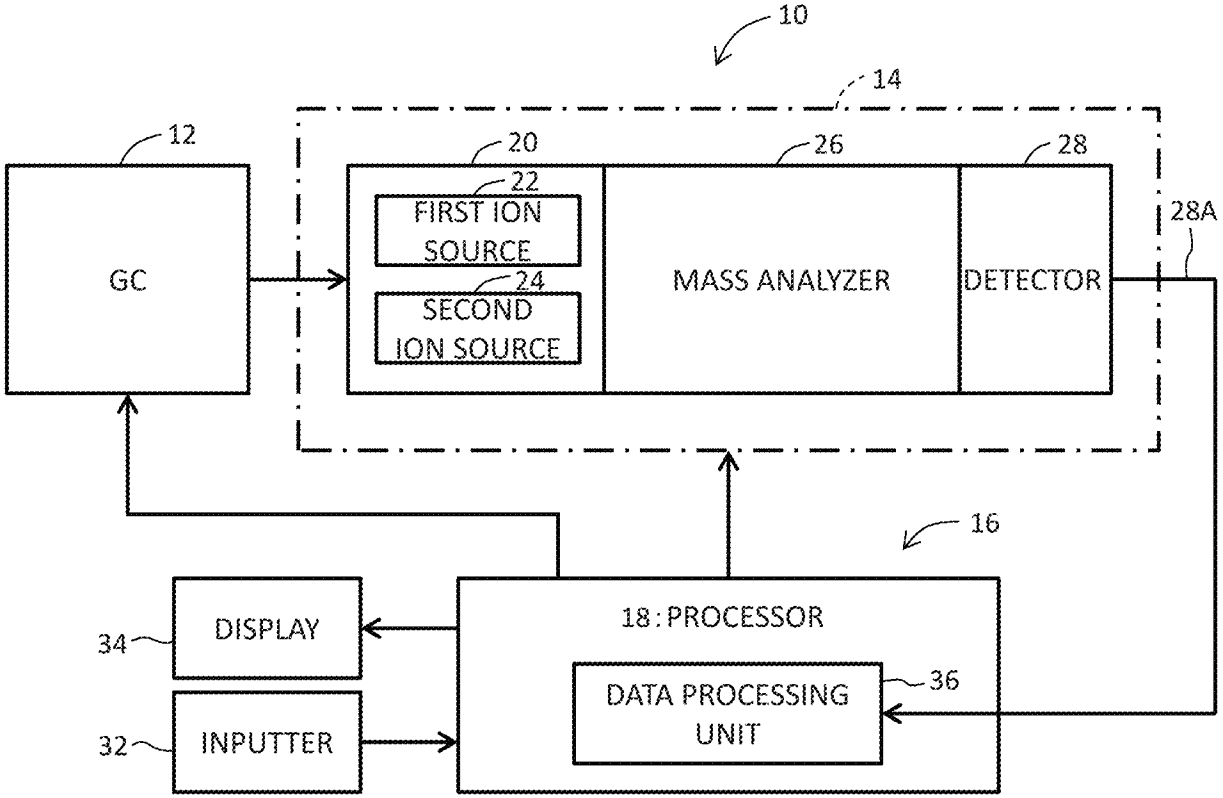
FIG. 1 is a block diagram of a mass analysis system according to an embodiment of the present disclosure.

An embodiment of the present disclosure will now be described with reference to the drawings.

(1) Overview of Embodiment

A mass spectrum processing apparatus according to an embodiment of the present disclosure comprises: a composition estimator; a primary pattern matching unit; and a first secondary pattern matching unit. The composition estimator estimates a composition based on at least one of a first monoisotopic peak included in a first peak group in a first mass spectrum produced through soft ionization of a sample, or a second monoisotopic peak included in a second peak group in a second mass spectrum produced through hard ionization of the sample. The primary pattern matching unit attempts primary pattern matching between the first peak group and the second peak group. The first secondary pattern matching unit attempts, when the primary pattern matching is successful, secondary pattern matching between a representative peak group which represents the first peak group and the second peak group, and an isotope pattern theoretically derived from the estimated composition, to thereby evaluate the estimated composition.

The soft ionization and the hard ionization are relative concepts, distinguished in the viewpoint of ease of production of fragment ions. In an embodiment of the present disclosure, the soft ionization is ionization in which a proton adding phenomenon may occur. The first peak group basically corresponds to one of a simple isotope pattern of a molecular ion $[M]^+$, a simple isotope pattern of a molecular ion $[M+1]^+$, or a combined isotope pattern in which these isotope patterns are overlapped. Here, "+1" means an addition of a proton H. The simple isotope pattern means a non-combined isotope pattern.

On the other hand, the hard ionization is ionization in which a hydrogen desorbing phenomenon may occur. The second peak group basically corresponds to one of the simple isotope pattern of the molecular ion $[M]^+$, a simple isotope pattern of a molecular ion $[M-1]^+$, or a combined isotope pattern in which these isotope patterns are overlapped. Here, "−1" means desorption of hydrogen, H.

The primary pattern matching is pattern matching between a measured isotope pattern which is the first peak group and a measured isotope pattern which is the second peak group. With the attempt of the primary pattern matching, a relationship between the first peak group and the second peak group may be identified. More specifically, when the primary pattern matching is successful, it is highly likely that both the first peak group and the second peak group are simple isotope patterns. On the other hand, when the primary pattern matching is not successful, it is highly likely that at least one of the first peak group or the second peak group is a combined isotope pattern.

The secondary pattern matching is pattern matching between the measured isotope pattern and a theoretical isotope pattern. When the representative peak group which is set as the matching target is the simple isotope pattern, and the estimated composition has a certain appropriateness, the secondary pattern matching will be successful.

The composition estimation is basically performed based on the first monoisotopic peak, but alternatively, the composition estimation may be performed based on the second monoisotopic peak, or based on two monoisotopic peaks. In general, the first peak group is a molecular ion peak group with the first monoisotopic peak as a head peak, and the second peak group is a molecular ion peak group with the second monoisotopic peak as a head peak. There may be cases in which the second monoisotopic peak cannot be clearly identified (or, even further, when the second peak group cannot be clearly identified), and, in such cases, other evaluation methods are applied.

When the elements of a compound which is a mass analysis target are all primary isotopes (isotopes having the largest natural abundances), a peak corresponding to the compound is called a monoisotopic peak. Normally, a peak group having a molecular ion peak serving as the monoisotopic peak at a lowest-mass-side is used in the isotope pattern matching. The first peak group or the second peak group normally serves as the representative peak group, but alternatively, a representative peak group may be produced based on these peak groups.

In an embodiment of the present disclosure, the mass spectrum processing apparatus further comprises a mass difference calculator. The mass difference calculator calculates a mass difference between the first monoisotopic peak and the second monoisotopic peak. An influence of a difference of one hydrogen or two hydrogens on the isotope pattern of the molecular ion is small. Thus, the primary pattern matching unit relatively shifts one of the first peak group or the second peak group based on the mass difference, and then attempts the primary pattern matching. Either one of the peak groups may be shifted. Alternatively, the peak group may be logically shifted, without being actually shifted.

When the first monoisotopic peak is a peak corresponding to the molecular ion $[M]^+$ or a peak corresponding to the molecular ion $[M+1]^+$, and the second monoisotopic peak is a peak corresponding to the molecular ion $[M]^+$ or a peak corresponding to the molecular ion $[M-1]^+$, 0, 1, or 2 (in units of u) is determined as the mass difference. When one of the peak groups is shifted by an amount corresponding to the mass difference, it becomes possible to correctly correlate the first peak group and the second peak group on a mass axis (or on an m/z axis). That is, the primary pattern matching between the two peak groups can be enabled.

When a numerical value other than 0, 1, and 2 is determined as the mass difference, it is likely that the second peak group does not occur. Thus, application of the primary pattern matching is put off, and other evaluation methods are applied. More specifically, as will be described below, the composition is evaluated using isotope pattern matching based on the first peak group and isotope pattern matching based on a fragment peak group.

In an embodiment of the present disclosure, the mass spectrum processing apparatus further comprises a selector and a second secondary pattern matching unit. The selector selects, when the primary pattern matching is unsuccessful, a peak group, of the first peak group and the second peak group, having a higher likelihood of being a peak group derived from a single molecular ionic species, as a peak group of interest. The second secondary pattern matching unit attempts the secondary pattern matching between the peak group of interest selected by the selector and the isotope pattern theoretically derived from the estimated composition.

When the primary pattern matching is unsuccessful, it is estimated that at least one of the first peak group or the second peak group is likely the combined isotope pattern. At the same time, there is a possibility that one of these peak groups is a simple isotope pattern (a possibility that one of these peak groups is a peak group derived from a single molecular ionic species). In consideration of this, in the above-described configuration, a peak group of interest which is likely a simple isotope pattern is selected, and the secondary pattern matching is attempted on the peak group of interest.

In an embodiment of the present disclosure, the selector calculates a first ratio based on an intensity of a head peak in the first peak group, and a sum of intensities of a plurality of succeeding peaks in the first peak group. In addition, the selector calculates a second ratio based on an intensity of a head peak in the second peak group, and a sum of intensities of a plurality of succeeding peaks in the second peak group. The selector then selects the peak group of interest by comparing the first ratio and the second ratio.

In the case of the simple isotope pattern, the sum of the intensities of the succeeding peaks is relatively small as compared to the intensity of the head peak. On the other hand, in the case of the combined isotope pattern, the sum of the intensities of the succeeding peaks is relatively large as compared to the intensity of the head peak. Based on such a property, the peak group of interest may be selected. Alternatively, the peak group of interest may be selected by other methods.

In an embodiment of the present disclosure, the mass spectrum apparatus further comprises a fragment evaluator. The fragment evaluator evaluates, when the secondary pattern matching by the second secondary pattern matching unit is unsuccessful, the estimated composition based on a fragment ion peak group included in the first mass spectrum or the second mass spectrum.

In an embodiment of the present disclosure, the fragment evaluator comprises a fragment composition estimator, and a fragment pattern matching unit. The fragment composition estimator estimates a fragment composition based on a head peak in the fragment ion peak group. The fragment pattern matching unit attempts fragment pattern matching between the fragment ion peak group and a fragment isotope pattern theoretically derived from the fragment composition.

In general, a plurality of peak groups obtained by detection of fragment ions may include a peak group corresponding to the simple isotope pattern. By performing fragment isotope pattern matching using such a peak group, the composition may be evaluated. When, for example, a fragment composition estimated from the head peak is $C_2H_4O_2$, and the composition to be evaluated is, for example, $C_{10}H_{20}O$, a number of oxygen atoms in the fragment exceeds a number of oxygen atoms in the molecular ion. When such a non-matching or contradictory relationship is found, the composition may be removed from the evaluation target before the isotope pattern matching is performed.

In an embodiment of the present disclosure, the mass spectrum processing apparatus further comprises a pattern matching unit. The pattern matching unit attempts, when the second mass spectrum does not include the second peak group, pattern matching between the first peak group and the isotope pattern theoretically derived from the estimated composition.

In the above-described configuration, pattern matching similar to the related art is performed between the first peak group and the isotope pattern, when the first mass spectrum includes the first peak group, and the second mass spectrum does not include the second peak group. Then, the composition is evaluated using the fragment ion peak group as described below, as necessary.

In an embodiment of the present disclosure, the mass spectrum processing apparatus further comprises a fragment evaluator. The fragment evaluator evaluates, when the pattern matching by the pattern matching unit is unsuccessful, the estimated composition based on a fragment ion peak group included in the first mass spectrum or the second mass spectrum.

In an embodiment of the present disclosure, the fragment evaluator comprises a fragment composition estimator and a fragment pattern matching unit. The fragment composition estimator estimates a fragment composition based on a head peak in the fragment ion peak group. The fragment pattern matching unit attempts fragment pattern matching between the fragment ion peak group and a fragment isotope pattern theoretically derived from the fragment composition.

A method of processing a mass spectrum according to an embodiment of the present disclosure comprises a composition estimating step, and a step of evaluating the estimated composition. The composition estimating step is a step in which a composition is estimated based on at least one of a first monoisotopic peak included in a first peak group in a first mass spectrum produced through soft ionization of a sample, or a second monoisotopic peak included in a second peak group in a second mass spectrum produced through hard ionization of the sample. The step of evaluating the estimated composition utilizes primary pattern matching between the first peak group and the second peak group, and secondary pattern matching between a measured isotope pattern which is the first peak group or the second peak group, and a theoretical isotope pattern theoretically derived from the estimated composition.

The above-described method may be realized as a function of hardware or a function of software. In the case of the latter, a program executing the method is installed to an information processor via a network or via a transportable recording medium. The concept of the information processor includes a mass spectrum processing apparatus, and also a mass analysis apparatus or a mass analysis system.

(2) Details of Embodiment

FIG. 1 shows an example configuration of a mass analysis system according to an embodiment of the present disclosure. A mass analysis system 10 temporally separates a plurality of compounds included in an original sample, and performs mass analysis on each of the compounds. The mass analysis system 10 shown in FIG. 1 more specifically comprises a gas chromatograph apparatus 12, a mass analysis apparatus 14, and an information processor 16. Alternatively, the gas chromatograph apparatus 12 may be omitted. Alternatively, in place of the gas chromatograph apparatus 12, a liquid chromatograph apparatus or the like may be used.

When the original sample is introduced to the gas chromatograph apparatus 12, a plurality of compounds which are temporally separated appear on an output side of the gas chromatograph apparatus 12. The plurality of compounds are samples serving as analysis targets from the viewpoint of the mass analysis apparatus 14. The plurality of compounds thus separated are sequentially introduced to the mass analysis apparatus 14. In the illustrated example configuration, the mass analysis apparatus 14 comprises an ion source unit 20, a mass analyzer 26, and a detector 28. In the present embodiment, two measurements on the same original sample are repeatedly executed. One measurement includes composition separation and mass analysis.

In the present embodiment, the ion source unit 20 includes a first ion source 22 and a second ion source 24 which are selectively used. The first ion source 22 is a hard ion source. More specifically, the first ion source 22 is an ion source which follows the electron ionization (EI) method. According to the first ion source 22, in general, a relatively large number of fragment ions can be produced.

The second ion source 24 is a soft ion source. That is, the second ion source 24 is an ion source which follows, for example, the field ionization method. According to the second ion source 24, fragment ions tend to be not produced, but the molecular ions can be clearly detected. Examples of a second ionization method include, in addition to the field ionization method, a chemical ionization method, a field desorption ionization method, a photoionization method, and the like. For the measurement of two times, the ion source to be actually used is sequentially selected through electric switching, mechanical switching, or manual switching. An order of selection of the ion sources may be arbitrarily determined.

In the selected ion source, ions are produced from the sample introduced thereto. The ions are guided by an action of an electric field to the mass analyzer 26. Alternatively, two lines of mass analysis subsystems may be placed in parallel to each other. In this case, the two ion sources may be operated in parallel to each other. In this case, the individual mass analysis subsystem is formed from the mass analyzer and the detector to be described below.

The mass analyzer 26 performs mass analysis on ions generated by the ion source unit 20 based on a mass-to-charge ratio (m/z) of each ion. For example, when the mass analyzer 26 is a time-of-flight type mass analyzer, the individual ions are detected by the detector 28 after a time of flight corresponding to the mass-to-charge ratio of each of the ions. Alternatively, a mass analyzer of other types (such as, for example, a magnetic field sector type mass analyzer, a quadrupole type mass analyzer, or the like) may be used. The detector 28 detects ions, and specifically has an electron multiplier tube. A detection signal 28A is output from the detector 28. The detection signal 28A is sent to the information processor 16 via a signal processor circuit (not shown).

The information processor 16 corresponds to a mass spectrum processing apparatus, and comprises a processor 18, an inputter 32, a display 34, or the like, and also a memory (not shown). The processor 18 is formed from, for example, a CPU which executes a program. Alternatively, in place of or along with the processor 18, various calculation devices may be used. Alternatively, the information processor 16 may be formed from a plurality of computers. Alternatively, functions of a part of the computers may be present on a network.

The processor 18 functions as a calculator, a controller, and a processing unit. A data processing function of the processor 18 is shown on FIG. 1 as a data processing unit 36. As will be described below, the data processing unit 36 functions as a spectrum producer, a composition estimator, and a composition evaluator. In addition, in evaluating the composition, the data processing unit 36 functions as a mass difference calculator, a primary pattern matching unit, a first secondary pattern matching unit, a ratio calculator, a selector, an isotope pattern producer, a second secondary pattern matching unit, a fragment pattern matching unit, or the like.

The memory is formed from a semiconductor memory, a hard disk drive, or the like. On the memory, a plurality of programs executed by the CPU are stored. These programs include a spectrum processing program and a composition estimating program. On the memory, a composition estimation database is constructed. Alternatively, the composition estimation database may be constructed on a storage connected to the information processor 16 via a network. The composition estimation database has information which is referred to when a composition of molecular ions (overall composition) is estimated and a composition of fragment ions (partial composition) is estimated.

The inputter 32 is formed from a keyboard, a pointing device, or the like. Using the inputter 32, for example, a user selects a peak and inputs a processing condition. In the present embodiment, using the inputter 32, the user designates a composition search range, as a composition estimating condition. The composition search range more specifically includes a plurality of atomic number ranges corresponding to a plurality of elements. Each atomic number range is defined by a lower limit and an upper limit. The composition estimating condition which is input is displayed on the display 34 to be described below, and is also registered in the memory. When the composition estimating condition is changed as will be described below, the composition estimating condition after the change is displayed on the display 34 and is registered in the memory.

The display 34 functions as a display unit, and is more specifically formed from a liquid crystal display, an organic EL device, or the like. On a display screen of the display 34, a chromatogram, a mass spectrum, the composition search range, difference information (such as neutral loss or the like), a composition estimation result, a composition evaluation result, or the like is displayed.

A composition evaluation method according to the present embodiment will now be described in detail with reference to figures from FIG. 2 and on.

Figure 2:
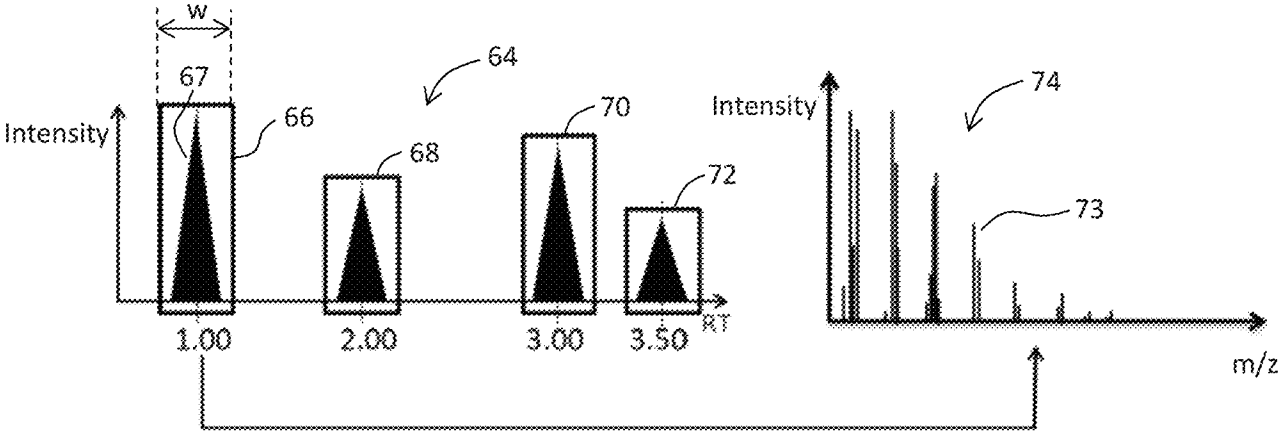
FIG. 2 is a diagram showing a first chromatogram and an EI mass spectrum.

FIG. 2 shows a chromatogram 64 produced using the first ion source; that is, produced through hard ionization of the sample. In the chromatogram 64, a vertical axis shows TIC (Total Ion Current), and a horizontal axis shows RT (Retention Time). The chromatogram 64 (and a chromatogram 75 shown in FIG. 3) is produced from a mass spectrum array based on a detected signal, by the data processing unit shown in FIG. 1.

In the chromatogram 64, a plurality of compound peaks 67 appear at different times on the retention time axis. Windows 66, 68, 70, and 72 are set for the plurality of compound peaks 67, and a mass spectrum is accumulated in each of the windows 66, 68, 70, and 72. A parameter w shows a width of the window 66. The parameter w is set in advance or is set individually or dynamically. The mass spectrum is repeatedly produced by the data processing unit shown in FIG. 1, based on the detected signal, and in a certain time interval.

For each of the windows 66, 68, 70, and 72, a plurality of mass spectra observed in the corresponding period are accumulated, to produce an accumulated mass spectrum. FIG. 2 exemplifies an accumulated mass spectrum 74 produced by accumulating a plurality of mass spectra observed in the window 66. In the illustrated example configuration, in the accumulated mass spectrum 74, a molecular ion peak group is not clear. On the other hand, as shown by reference numeral 73, a plurality of fragment ion peak groups appear. Depending on the conditions, the molecular ion peak group may clearly appear also on the accumulated mass spectrum 74.

Figure 3:
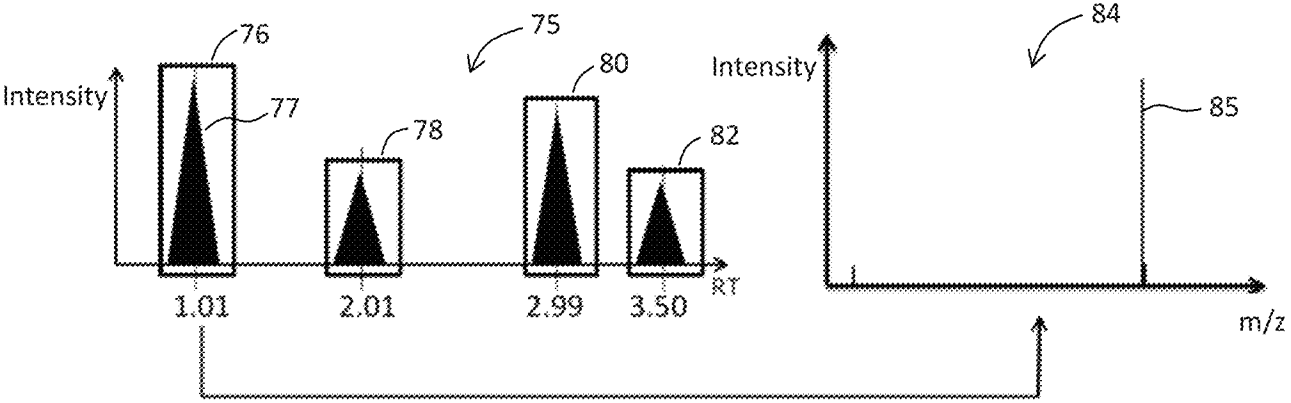
FIG. 3 is a diagram showing a second chromatogram and an SI mass spectrum.

FIG. 3 shows the chromatogram 75 produced using the second ion source; that is, produced through soft ionization of the sample. Similar to the chromatogram 64 shown in FIG. 2, in the chromatogram 75 also, a plurality of compound peaks 77 appear at different times on the retention time axis. For these peaks, windows 76, 78, 80, and 82 for accumulation are set.

Between the chromatograph 64 and the chromatogram 75, positions of occurrence of the plurality of compound peaks 67 and 77 are slightly deviated in the retention time axis direction. In the present embodiment, in consideration of such a deviation, compound peak pairs are correlated; that is, pairing is executed, between the chromatogram 64 and the chromatogram 75. In this case, for example, with a peak top in one chromatogram as a reference, a search range is set on the other chromatogram, and a peak top may be searched in the search range. In the pairing, a method of using a center of gravity, a method of using waveform fitting, or the like may be used.

In the plurality of windows 76, 78, 80, and 82, the mass spectra are accumulated to produce a plurality of accumulated mass spectra. FIG. 3 exemplifies an accumulated mass spectrum 84 produced by the accumulation of mass spectra in the window 76. In the accumulated mass spectrum 84, there is almost no fragment ion peak, but a molecular ion peak group 85 is clear. Depending on the conditions, a plurality of fragment ion peak groups may clearly appear in the accumulated mass spectrum 84.

In this manner, between the two chromatograms, an accumulated mass spectrum pair is produced for each peak pair which is paired. For each compound separated by the gas chromatograph apparatus, the accumulated mass spectrum pair as described is produced. For each accumulated mass spectrum pair, a composition of the compound is estimated, and the estimated composition is evaluated. Alternatively, from a plurality of composition candidates which are estimated, a most probable composition candidate is selected. In the following, the accumulated mass spectrum produced through the soft ionization of the sample will be referred to as an "SI mass spectrum", and the accumulated mass spectrum produced through the hard ionization of the sample will be referred to as an "EI mass spectrum".

Figure 4:
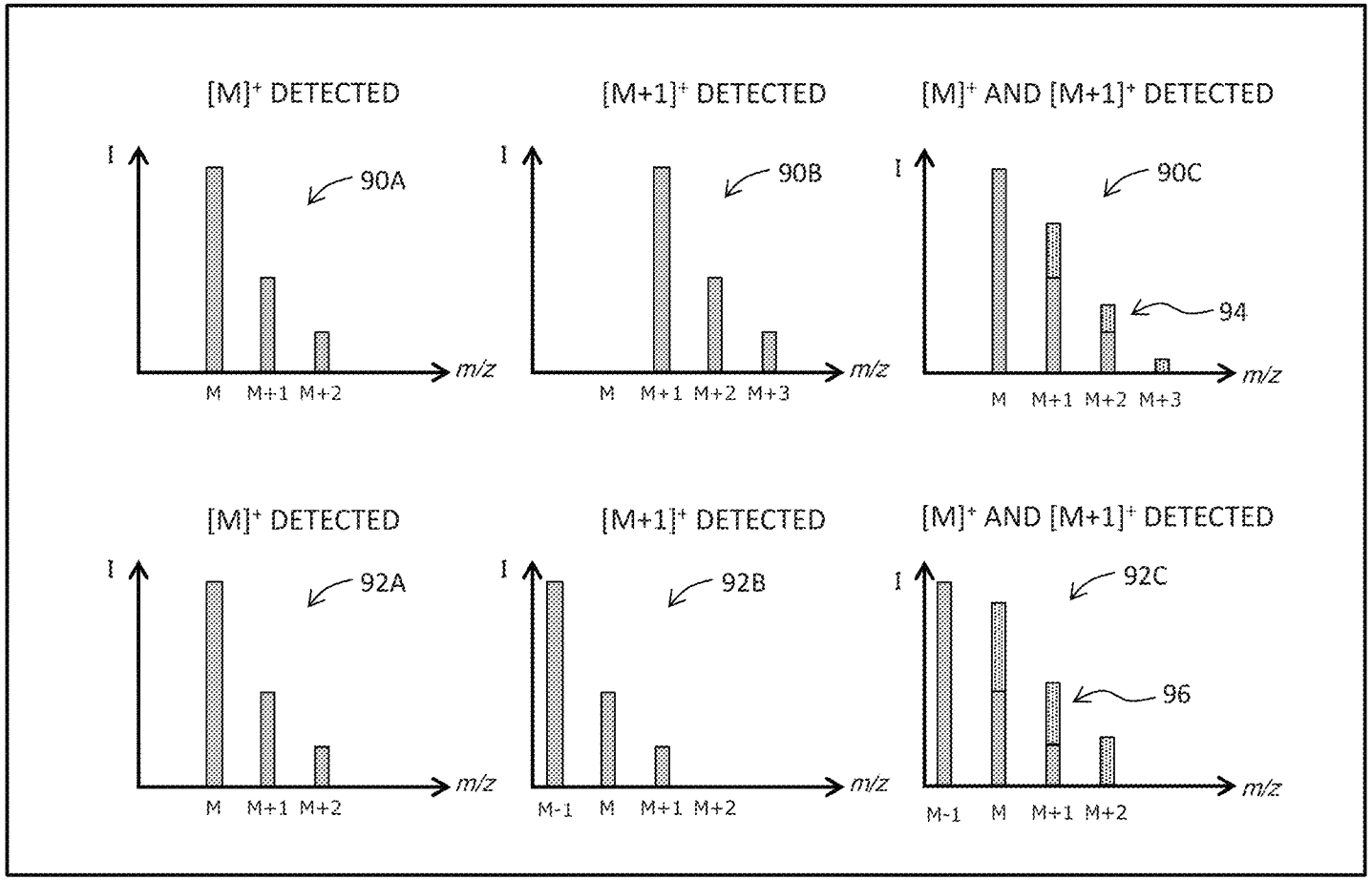
FIG. 4 is a diagram showing a plurality of types of measured isotope patterns which may be included in an SI mass spectrum and an EI mass spectrum.

At an upper part of FIG. 4, a plurality of types of first peak groups which may be included in the SI mass spectrum are shown. At a lower part of FIG. 4, a plurality of types of second peak groups which may be included in the EI mass spectrum are shown. Each peak group is formed from a first monoisotopic peak (head peak) and a plurality of succeeding peaks succeeding the first monoisotopic peak (a plurality of isotope peaks of second and later orders). The illustration of FIG. 4 is merely exemplary, and does not show a form of each peak group in an exact shape.

More specifically, at the upper part of FIG. 4, three peak groups 90A, 90B, and 90C which may be included in the SI mass spectrum are shown. The peak group 90A is a simple isotope pattern which occurs when the molecular ion $[M]^+$ is detected, the peak group 90B is a simple isotope pattern which occurs when the molecular ion $[M+1]^+$ is detected, and the peak group 90C is a combined isotope pattern which occurs when the molecular ion $[M]^+$ and the molecular ion $[M+1]^+$ are detected. As shown by reference numeral 94, the peak group 90C corresponds to an overlap of two isotope patterns.

Similarly, at the lower part of FIG. 4, three peak groups 92A, 92B, and 92C which may be included in the EI mass spectrum are shown. The peak group 92A is a simple isotope pattern which occurs when the molecular ion $[M]^+$ is detected, the peak group 92B is a simple isotope pattern which occurs when the molecular ion $[M-1]^+$ is detected, and the peak group 92C is a combined isotope pattern which occurs when the molecular ion $[M]^+$ and the molecular ion $[M-1]^+$ are detected. As shown by reference numeral 96, the peak group 92C corresponds to an overlap of two isotope patterns.

Figure 5:
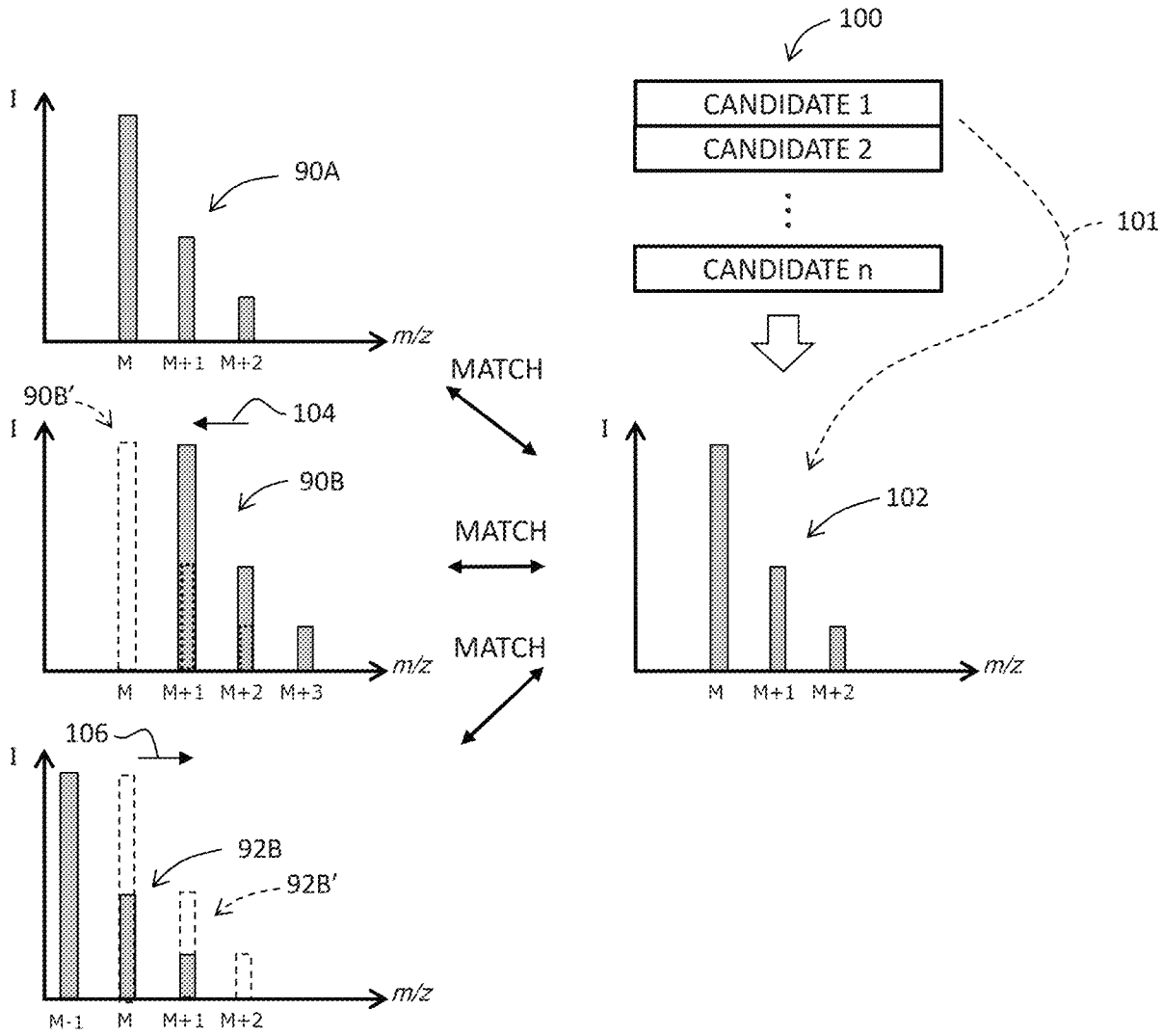
FIG. 5 is a diagram showing an example of pattern matching between a measured isotope pattern and a theoretical isotope pattern.

FIG. 5 shows isotope pattern matching. A plurality of composition candidates are estimated based on a precise mass of one of monoisotopic peaks. The composition candidates form a composition candidate list 100. The monoisotopic peak is selected by the user or automatically. For each composition candidate, the composition evaluation of the present embodiment is applied.

As shown by reference numeral 101, based on each composition candidate, an isotope pattern 102 is theoretically produced. Here, pattern matching will be considered between the three peak groups 90A, 90B, and 92B shown in FIG. 4 (measured isotope patterns) and the isotope pattern 102 (theoretical isotope pattern).

Because the peak group 90A is the simple isotope pattern, the peak group 90A and the theoretical isotope pattern 102 match each other. Although the peak group 90B is the simple isotope pattern, there is a mass difference of 1 u between the peak group 90B and the theoretical isotope pattern 102. Thus, the mass difference is first resolved, and then, the pattern matching is applied. Specifically, the peak group 90B is shifted to a low-mass side by −1 u as shown by reference numeral 104, and the pattern matching is then performed between the shifted peak group 90B' and the theoretical isotope pattern 102. The shifter peak group 90B' and the theoretical isotope pattern 102 match each other. Although the peak group 92B is also the simple isotope pattern, there is a mass difference of 1 u between the peak group 92B and the theoretical isotope pattern 102. Thus, the mass difference is first resolved, and the pattern matching is then applied. Specifically, the peak group 92B is shifted to a high-mass side by +1 u as shown by reference numeral 104, and then, the pattern matching is performed between the shifted peak group 92B' and the theoretical isotope pattern 102. The shifted peak group 92B' and the theoretical isotope pattern 102 match each other. When the isotope pattern matching is successful, appropriateness of the estimated composition can be evaluated. For example, when a similarly of two patterns is greater than or equal to a predetermined threshold, matching of the two patterns is determined.

Figure 6:
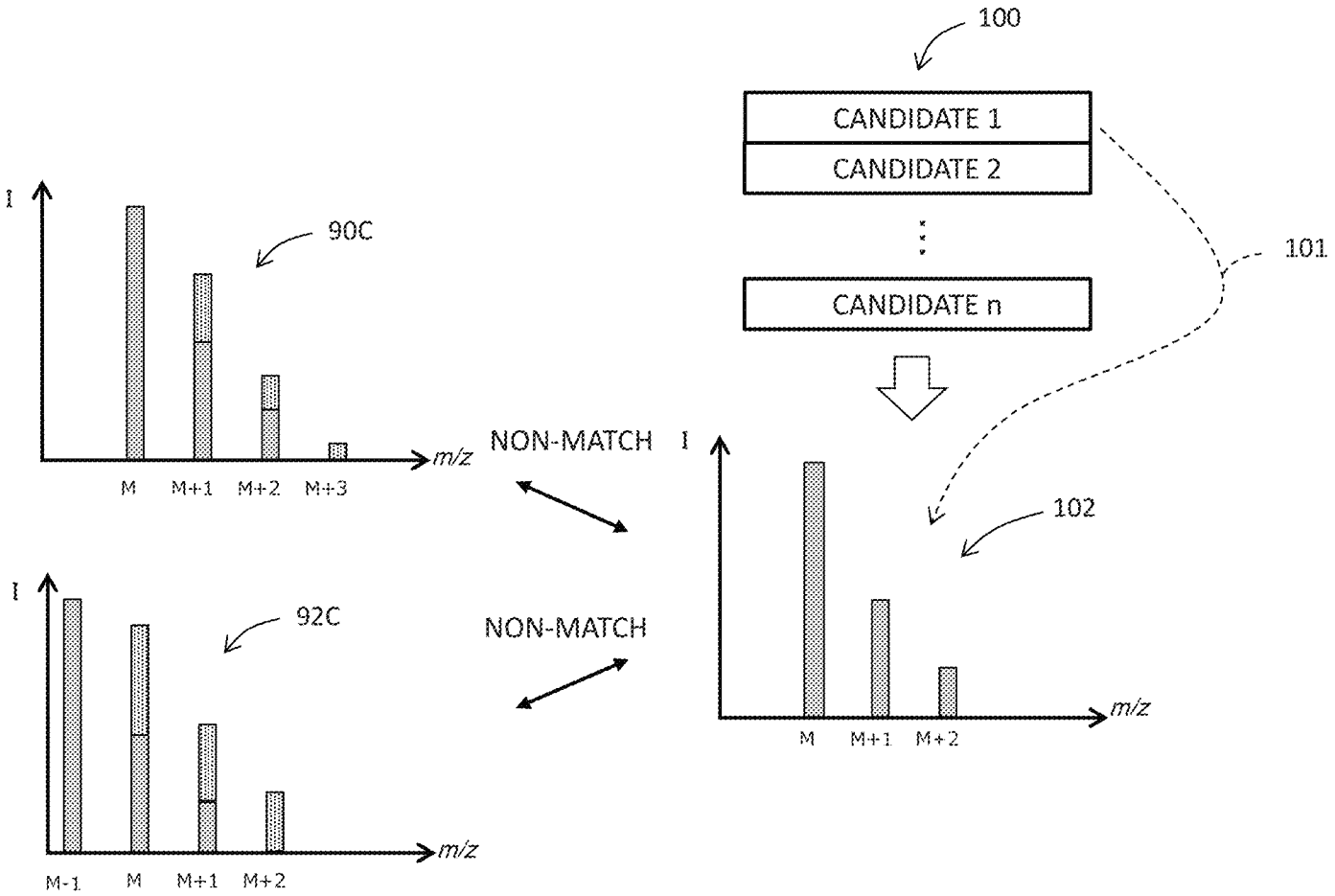
FIG. 6 is a diagram showing another example of the pattern matching between the measured isotope pattern and the theoretical isotope pattern.

On the other hand, FIG. 6 shows another type of isotope pattern matching. In FIG. 6, elements shown in FIG. 5 are assigned the same reference numerals, and their descriptions will not be repeated. The peak group 90C is the combined isotope pattern, and does not match the theoretical isotope pattern 102 with or without a shift. Similarly, the peak group 92C is also the combined isotope pattern, and does not match the theoretical isotope pattern 102 with or without a shift. Therefore, when the composition evaluation is to be performed using the isotope pattern matching, desirably, a type of the peak group to be considered is identified prior to the isotope pattern matching.

Figure 7:
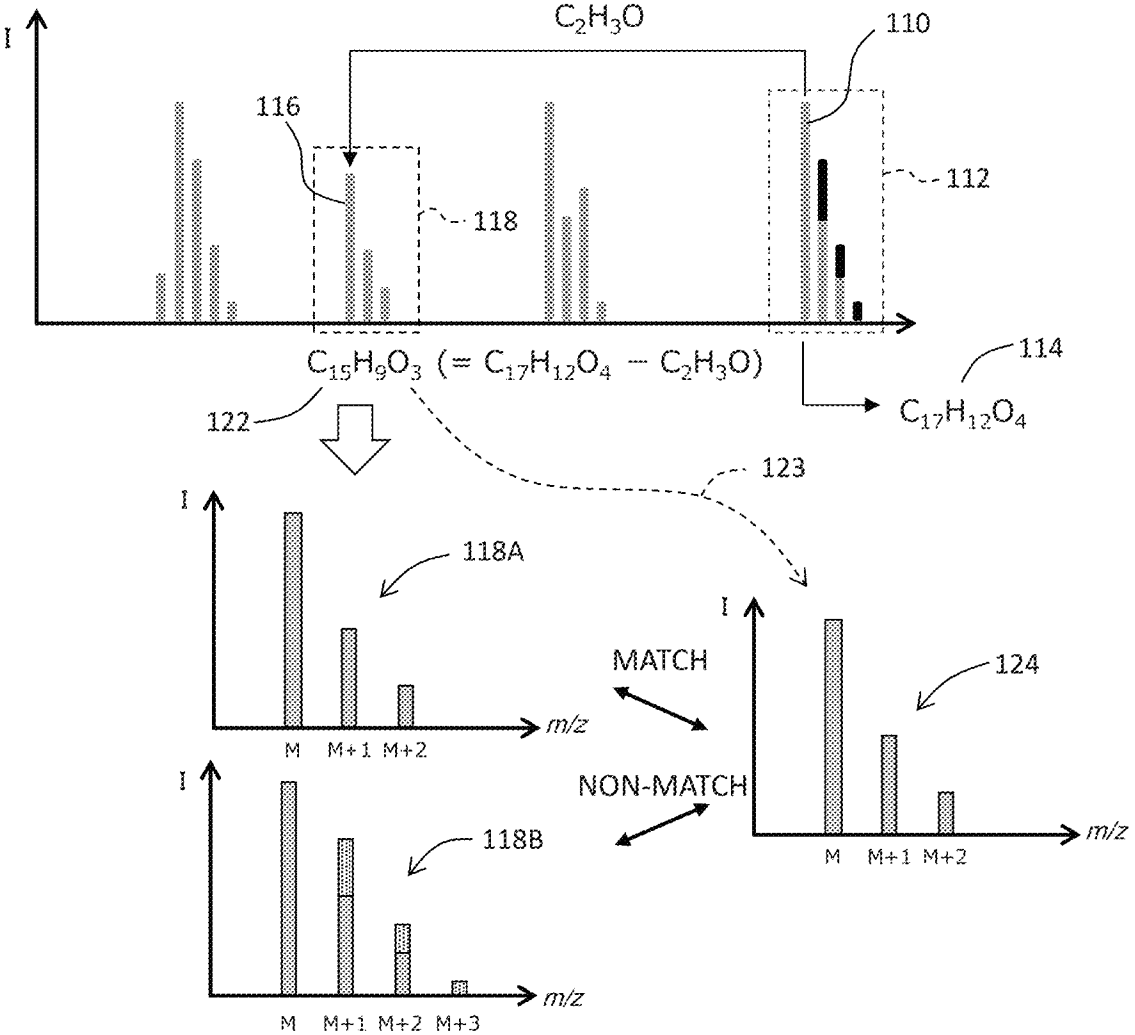
FIG. 7 is a diagram showing pattern matching between a measured isotope pattern of fragment ions and a theoretical isotope pattern of fragment ions.

As shown in FIG. 7, the above description is also applicable to a case when the isotope pattern matching is to be applied on a peak group which occurs in detection of fragment ions. In FIG. 7, a mass spectrum shown at the upper part includes a plurality of peak groups. A peak group shown by reference numeral 112 includes a molecular ion peak 110 serving as the monoisotopic peak. A peak group shown by reference numeral 118 includes a fragment ion peak 116 serving as the monoisotopic peak.

When the peak group 112 corresponds to the combined isotope pattern, in the evaluation of an estimated composition 114, a mass difference (neutral loss) is calculated between the molecular ion peak 110 and the fragment ion peak 116. Based on the mass difference, a partial composition 120 is estimated. By subtracting the partial composition 120 from the composition 114, a composition 122 corresponding to the fragment ion peak 116 (fragment composition) is estimated.

As shown by reference numeral 123, a theoretical isotope pattern 124 is produced based on the fragment composition 122. When the peak group 118 is a peak group 118A, because the peak group 118A corresponds to the simple isotope pattern, the peak group matches the theoretical isotope pattern 124. On the other hand, when the peak group 118 is a peak group 118B, because the peak group 118B corresponds to the combined isotope pattern, the peak group does not match the theoretical isotope pattern 124.

In fact, normally, the plurality of fragment peak groups included in the mass spectrum include a certain number of fragment peak groups corresponding to the simple isotope pattern. Therefore, in performing the isotope pattern matching, desirably, the plurality of fragment peak groups are referred to.

FIG. 8 shows a relationship between a plurality of types of the peak groups which may be observed under the soft ionization and a plurality of types of the peak groups which may be observed under the hard ionization, summarized two-dimensionally. Under the soft ionization, a proton adding phenomenon may occur. Thus, under the soft ionization, a peak group which is an isotope pattern of the molecular ion $[M]^+$, a peak group which is an isotope pattern of the molecular ion $[M+1]^+$, and a peak group corresponding to an overlap of these isotope patterns may be observed.

On the other hand, under the hard ionization, a hydrogen desorbing phenomenon may occur. Thus, under the hard ionization, a peak group which is an isotope pattern of the molecular ion $[M]^+$, a peak group which is an isotope pattern of the molecular ion $[M-1]^+$, and a peak group corresponding to an overlap of these isotope patterns may be observed.

As shown in FIG. 8, theoretically, 16 combinations (observation forms) #00~#33 may be considered. However, under the soft ionization, because the molecular ion $[M]^+$ (or the molecular ion $[M+1]^+$) is basically detected, #00, #10, #20, and #30 may be removed. Thus, in reality, 12 observation forms, #01~#03, #11~#13, #21~#23, and #31~#33 may occur.

Of the 12 observation forms, a group 130 is formed from observation forms #01, #02, and #03. These observation forms correspond to cases in which the molecular ion $[M]^+$ (or the molecular ion $[M-1]^+$) is not detected under the hard ionization.

Whether a current observation result corresponds to an observation form, among the 12 observation forms, belonging to the group 130, or corresponds to one of the others, 9 observation forms, #11~#13, #21~#23, and #31~#33, may be distinguished by calculating a difference in two monoisotopic masses corresponding to the two monoisotopic peaks included in the two mass spectra; that is, a mass difference. Specifically, when the mass difference is a number other than 0, 1, or 2 (when the molecular ion peak serving as a monoisotopic peak is not included in the mass spectrum produced under the hard ionization), the current situation belongs to the group 130. When the mass difference is 0, 1, or 2, the current observation result corresponds to one of the 9 observation forms, #11~#13, #21~#23, and #31~#33.

Four observation forms, #11, #12, #21, and #22, forming a group 132 presume that two peak groups are both simple isotope patterns. Therefore, when the mass difference is 0, 1, or 2, and the primary pattern matching (matching between two measured isotope patterns) is successful, normally, the secondary pattern matching (matching between a measured isotope pattern and a theoretical isotope pattern) will also be successful.

5 observation forms, #31, #32, #13, #23, and #33, presume that at least one peak group is the combined isotope pattern. Therefore, when the mass difference is 0, 1, and 2, and the primary pattern matching is unsuccessful, the current observation result corresponds to one of the 5 observation forms, #31, #32, #13, #23, and #33.

Of the 5 observation forms, #31, #32, #13, #23, and #33, groups 134 and 136 (more specifically, 4 observation forms, #31, #32, #13, and #23) presume that a peak group corresponding to the simple isotope pattern and a peak group corresponding to the combined isotope pattern are observed. Therefore, the former peak group is selected, and the secondary pattern matching is attempted on the selected peak group. From a selection target of the peak group, the group to which the current observation result belongs (group 134 or 136) is identified.

When the mass difference is 1, and the primary pattern matching and the secondary pattern matching are both unsuccessful, the current observation result corresponds to the observation form #33. In this case, the fragment pattern matching is applied. Similarly, when the mass difference is a number other than 0, 1, or 2, and the pattern matching is unsuccessful, the current observation result corresponds to the observation form #03, and in this case also, the fragment pattern matching is applied.

As described, according to the present embodiment, by applying the primary pattern matching and the secondary pattern matching stepwise, an evaluation method conforming to the current observation result can be selectively applied. Details will now be described.

Figure 9:
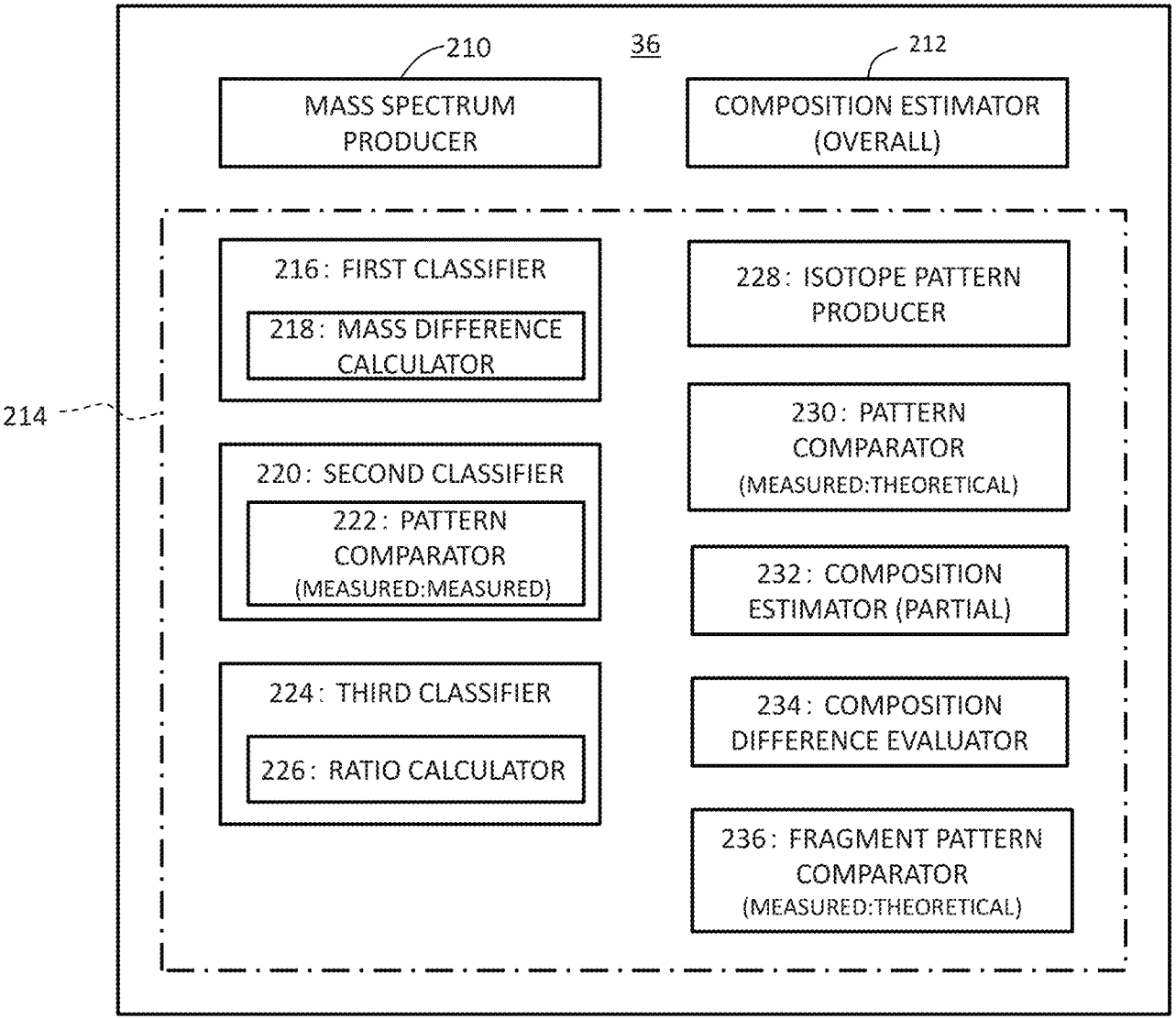
FIG. 9 is a diagram showing a plurality of functions of the data processing unit shown in FIG. 1.

FIG. 9 shows a plurality of functions of the data processing unit 36 shown in FIG. 1, as a plurality of blocks. The data processing unit 36 comprises a mass spectrum producer 210, a composition estimator 212, and an evaluator (narrowing-down unit) 214. In FIG. 1, illustration of a total ion current chromatogram (TICC) producer or the like is omitted.

The evaluator 214 has a first classifier 216 which functions as a first classifying unit. The first classifier 216 has a mass difference calculator 218 as a mass difference calculating unit. The mass difference calculator 218 calculates a mass difference between two molecular ion peaks (two monoisotopic peaks) included in two mass spectra. The two molecular ion peaks may be designated by the user or automatically.

The evaluator 214 has a second classifier 220 which functions as a second classifying unit. The second classifier 220 has a pattern comparator 222 which functions as a pattern comparing unit or a first pattern matching unit. With the pattern comparator 222, two peak groups included in two mass spectra; that is, two isotope patterns, are compared to each other. From a comparison result, an observation form or a group corresponding to the current observation result may be identified.

The evaluator 214 has a third classifier 224 which functions as a third classifying unit. The third classifier 224 also functions as a selector. The third classifier 224 has a ratio calculator 226 which functions as a ratio calculating unit. The ratio calculator 226 calculates a predetermined ratio for each of the peak groups when the primary pattern matching is unsuccessful, and a peak group corresponding to the simple isotope pattern is selected from two peak groups. The ratio indicates a degree of possibility that the peak group is the simple isotope pattern. The details of this process will be described later.

The evaluator 214 has an isotope pattern producer 228 which functions as an isotope pattern producing unit. The isotope pattern producer 228 produces an isotope pattern corresponding to the composition candidate. The isotope pattern is the theoretical isotope pattern.

The evaluator 214 has a pattern comparator 230 which functions as a pattern comparing unit, a first secondary pattern matching unit, and a second secondary pattern matching unit. The pattern comparator 230 performs the secondary pattern matching between the theoretical isotope pattern produced by the isotope pattern producer 228, and the measured isotope pattern which is the observed peak group.

The evaluator 214 has a composition estimator 232 which functions as a composition estimating unit, a composition difference evaluator 234 which functions as a composition difference evaluating unit, and a fragment pattern comparator 236 which functions as a fragment pattern comparing unit (or a fragment pattern matching unit).

The composition estimator 232 estimates a partial composition based on a mass difference (neutral loss) between a mass of the molecular ion peak (monoisotopic peak) and a mass of the fragment ion peak (monoisotopic peak). The estimated partial composition is compared to the composition candidates, so as to evaluate the appropriateness of the composition candidate.

The fragment pattern comparator 236 performs pattern matching between a theoretical isotope pattern based on the fragment composition estimated for the fragment peak, and the fragment ion peak group (measured isotope pattern), to evaluate the appropriateness of the composition candidate.

Figure 10:
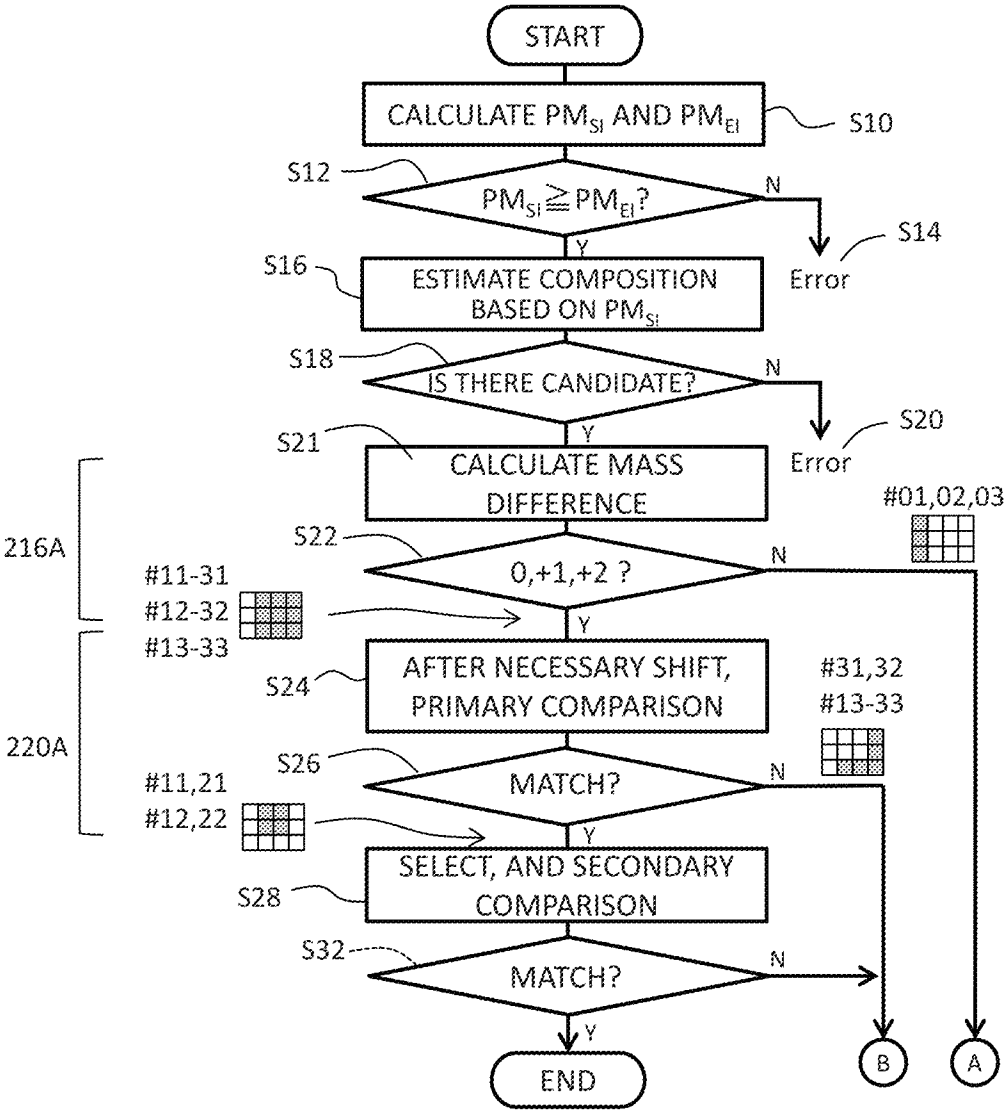
FIG. 10 is a diagram showing a part of a mass spectrum processing method according to an embodiment of the present disclosure.

Next, with reference to FIGS. 10 and 11, an evaluation method according to the present embodiment will be described in detail. In S10, two molecular ion peaks (two monoisotopic peaks) included in two mass spectra SI and EI produced under two ionization methods are identified, and masses thereof, $PM_{SI}$ and $PM_{EI}$ are calculated. In S12, the two masses $PM_{SI}$ and $PM_{EI}$ are compared to each other. If $PM_{SI} \geq PM_{EI}$, S16 is executed, and, if this is not the case, an error is judged in S14 and the process is completed. S12 is a step for checking that the molecular ion peak is included at least in the mass spectrum SI.

In S16, the composition is estimated based on the mass $PM_{SI}$. Normally, a composition candidate list formed from one or more composition candidates is formed. Alternatively, the composition candidate list may be produced based on $PM_{EI}$. In S18, it is checked whether or not there is at least one composition candidate, and, if not, an error is judged in S20, and the process is completed. For each composition candidate, a sequence of processes from S21 is executed. A process shown by reference numeral 216A corresponds to the first classifier shown in FIG. 9, and a process shown by reference numeral 220A corresponds to the second classifier shown in FIG. 9.

In S21, the mass difference is calculated by finding $PM_{SI}$-$PM_{EI}$. By calculating the mass difference, it is possible to identify that the two peak groups both exist, in particular, that a peak group exists in the mass spectrum EI. In FIGS. 10 and 11, a matrix shown in FIG. 8 is schematically drawn at each branch. A gray portion in each matrix shows a narrowed-down portion.

In S22, it is judged whether or not the mass difference is one of 0, +1, or +2. When judged NO, a process from S34 shown in FIG. 11 is executed. When judged YES, in S24, a shift corresponding to the mass difference is applied to the peak group included in the mass spectrum EI, and the primary pattern matching; that is, matching between two measured isotope patterns, is performed between two peak groups. When the primary pattern matching is successful (S26), S28 is executed, and when the primary pattern matching is unsuccessful, a process from S40 shown in FIG. 11 is executed.

In S28, a representative peak group which represents the two peak groups is selected from the two peak groups. Basically, either peak group may be selected. A selection rule may be defined in advance. Alternatively, the two peak groups may be combined. In S28, pattern matching is performed between the representative peak group which is the measured isotope pattern, and the theoretical isotope pattern produced from the estimated composition. This pattern matching corresponds to first secondary pattern matching. If the estimated composition candidate is appropriate, the secondary pattern matching will be successful. If the secondary pattern matching is unsuccessful, an error may be judged and the process may be completed. Alternatively, as shown in FIG. 10, the process from S40 may be executed, via S32.

Figure 11:
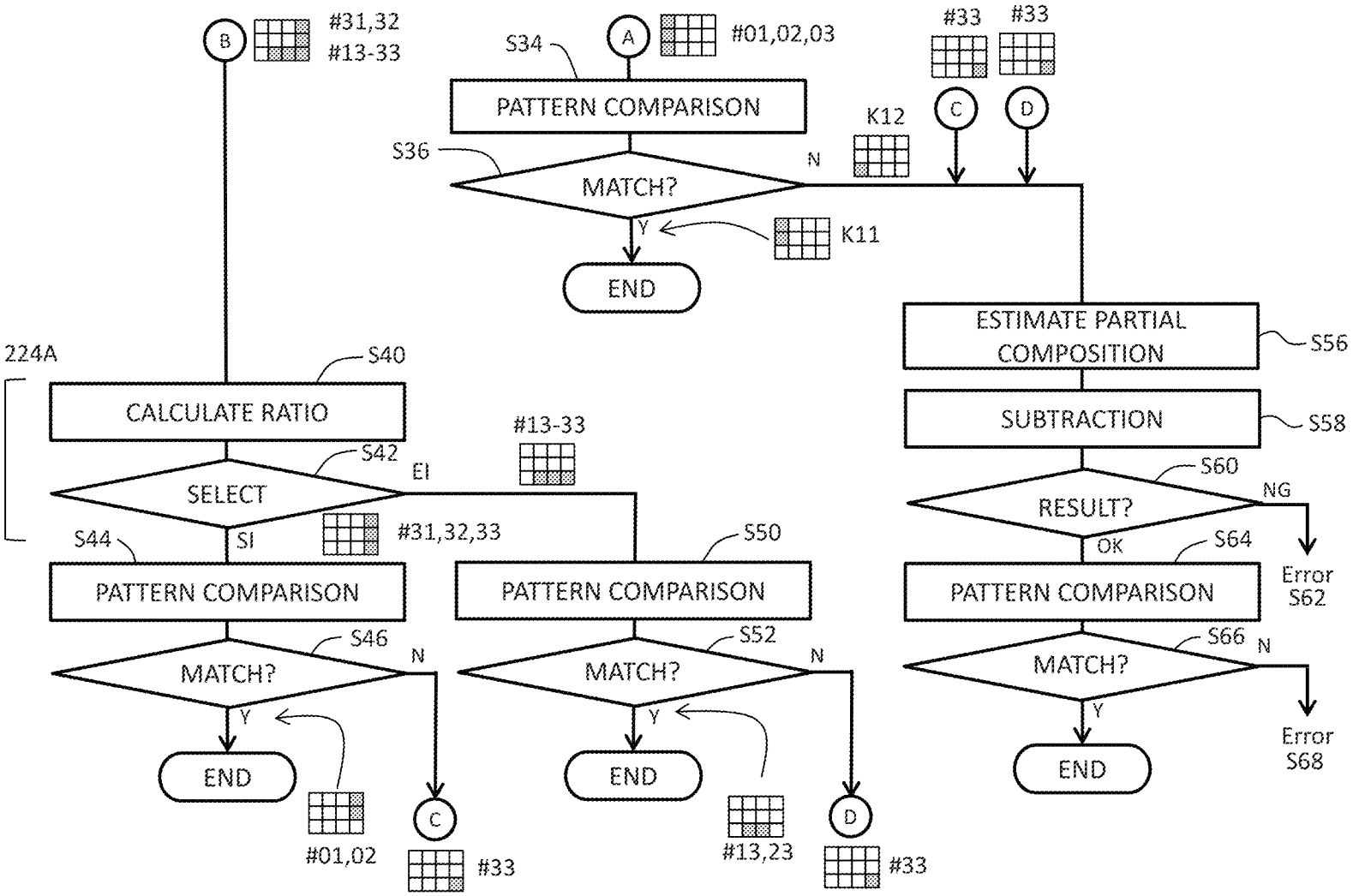
FIG. 11 is a diagram showing other parts of the mass spectrum processing method according to an embodiment of the present disclosure.

In FIG. 11, in S40, the ratio is calculated for each of the two peak groups.

Figure 12:
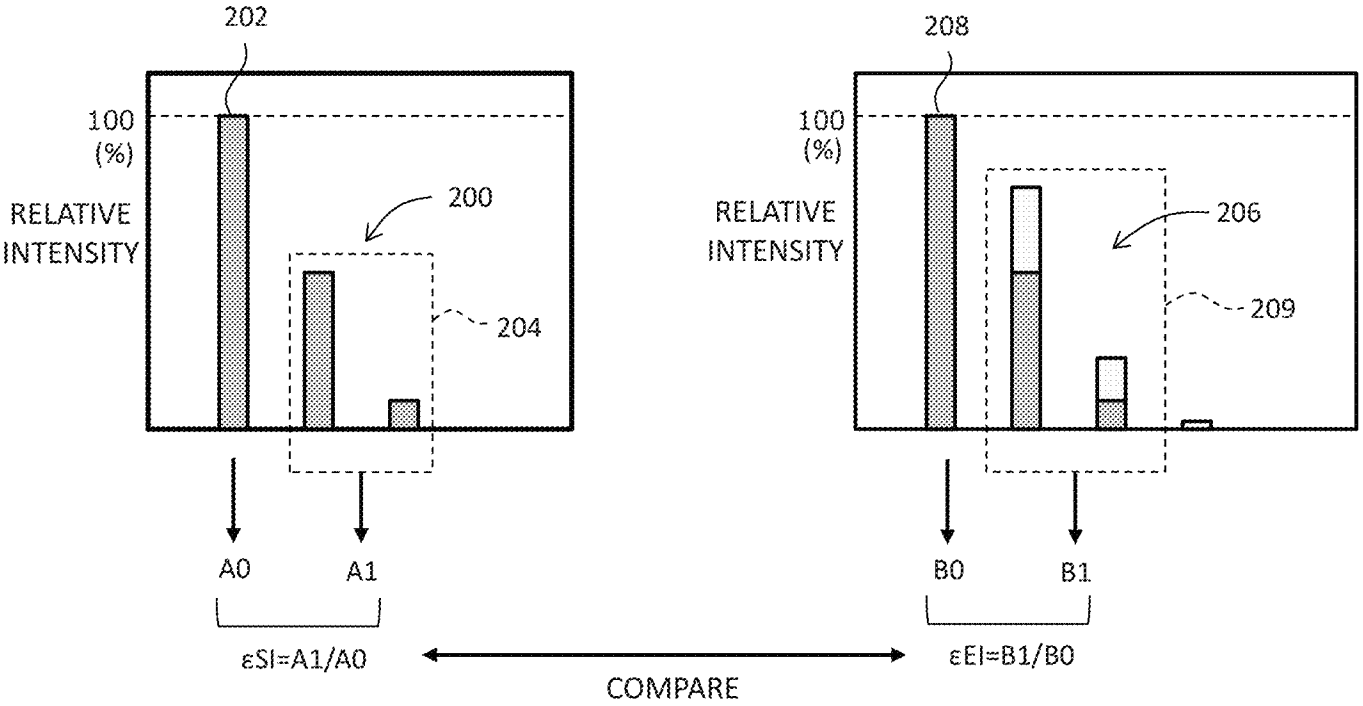
FIG. 12 is a diagram for explaining comparison of ratios.

FIG. 12 exemplifies a method of calculating the ratio. A first peak group 200 is formed from a head peak 202 and two succeeding peaks 204, and a second peak group 206 is formed from a head peak 208 and two succeeding peaks 209.

Based on the first peak group 200, a ratio $\varepsilon_{SI}$ (=A1/A0) between an intensity A0 of the head peak 202 and a sum A1 of intensities of the two succeeding peaks 204 is calculated. Similarly, based on the second peak group 206, a ratio $\varepsilon_{EI}$ (=B1/B0) between an intensity B0 of the head peak 208 and a sum B1 of intensities of the two succeeding peaks 209 is calculated. When the peak group corresponds to the simple isotope pattern, the ratio ε is small, and, if the peak group corresponds to the combined isotope pattern, the ratio ε is large. Thus, two ratios $\varepsilon_{SI}$ and $\varepsilon_{EI}$ are compared to each other, to identify the larger of the two ratios. The peak group with the smaller ratio ε is likely to correspond to the simple isotope pattern. Here, a number of the succeeding peaks to be included in the calculation of the intensity sum may be designated by the user in advance.

In FIG. 11, in S42, a peak group having the larger ratio is selected. That is, the first peak group in the SI mass spectrum or the second peak group in the EI mass spectrum is selected. When the first peak group is selected, S44 and S46 are executed. When the second peak group is selected, S50 and S52 are executed. In FIG. 11, a process shown by reference numeral 224A corresponds to the third classified shown in FIG. 9.

In S44, pattern matching (second secondary pattern matching) is performed between the measured isotope pattern which is the selected first peak group, and the theoretical isotope pattern derived from the composition candidate. If the two isotope patterns match (yes in S46), it is judged that the estimated composition is appropriate, and the process is completed. If the two isotope patterns do not match (no in S46), a process from S56 is executed.

In S50, pattern matching (second secondary pattern matching) is performed between the measured isotope pattern which is the selected second peak group, and the theoretical isotope pattern derived from the composition candidate. If the two isotope patterns match, it is judged that the estimated composition is appropriate (yes in S52), and the process is completed. If the two isotope patterns do not match (no in S52), similar to the above, the process from S56 is executed.

In S34, pattern matching is performed between the measured isotope pattern which is the first peak group in the SI mass spectrum, and the theoretical isotope pattern derived from the composition candidate. In S36, if it is judged that the pattern matching is successful, it is judged that the composition candidate is appropriate, and the process is completed.

On the other hand, if the pattern matching is unsuccessful in S36, a fragment process from S56 is executed. More specifically, the fragment process from S56 is individually applied to each of a plurality of fragment ion peak groups included in a certain mass range in the two mass spectra.

In S56, a mass difference (neutral loss) between the molecular ion peak (monoisotopic peak) and a head peak (monoisotopic peak) in the fragment ion peak group is calculated, and the partial composition is estimated from the mass difference. In S58, the partial composition is subtracted from the estimated composition candidate, to determine a composition corresponding to the head peak of the fragment ion peak group. If, as a result of the subtraction, a contradiction or a non-match occurs such as that a number of a particular atom is negative (ng in S60), an error is judged in S62, and the process is completed.

On the other hand, when the subtraction is successful in S60, in S64, pattern matching (third secondary pattern matching) is performed between the measured isotope pattern which is the fragment ion peak group, and a theoretical isotope pattern derived from the fragment composition identified by the subtraction. If the measured isotope pattern and the theoretical isotope pattern do not match (no in S66), an error is judged in S68, and the process is completed. If the measured isotope pattern and the theoretical isotope pattern match (yes in S66), it is judged that the composition candidate is appropriate, and the process is completed.

The fragment process from S56 will now be described with reference to FIGS. 13 and 14.

Figure 13:
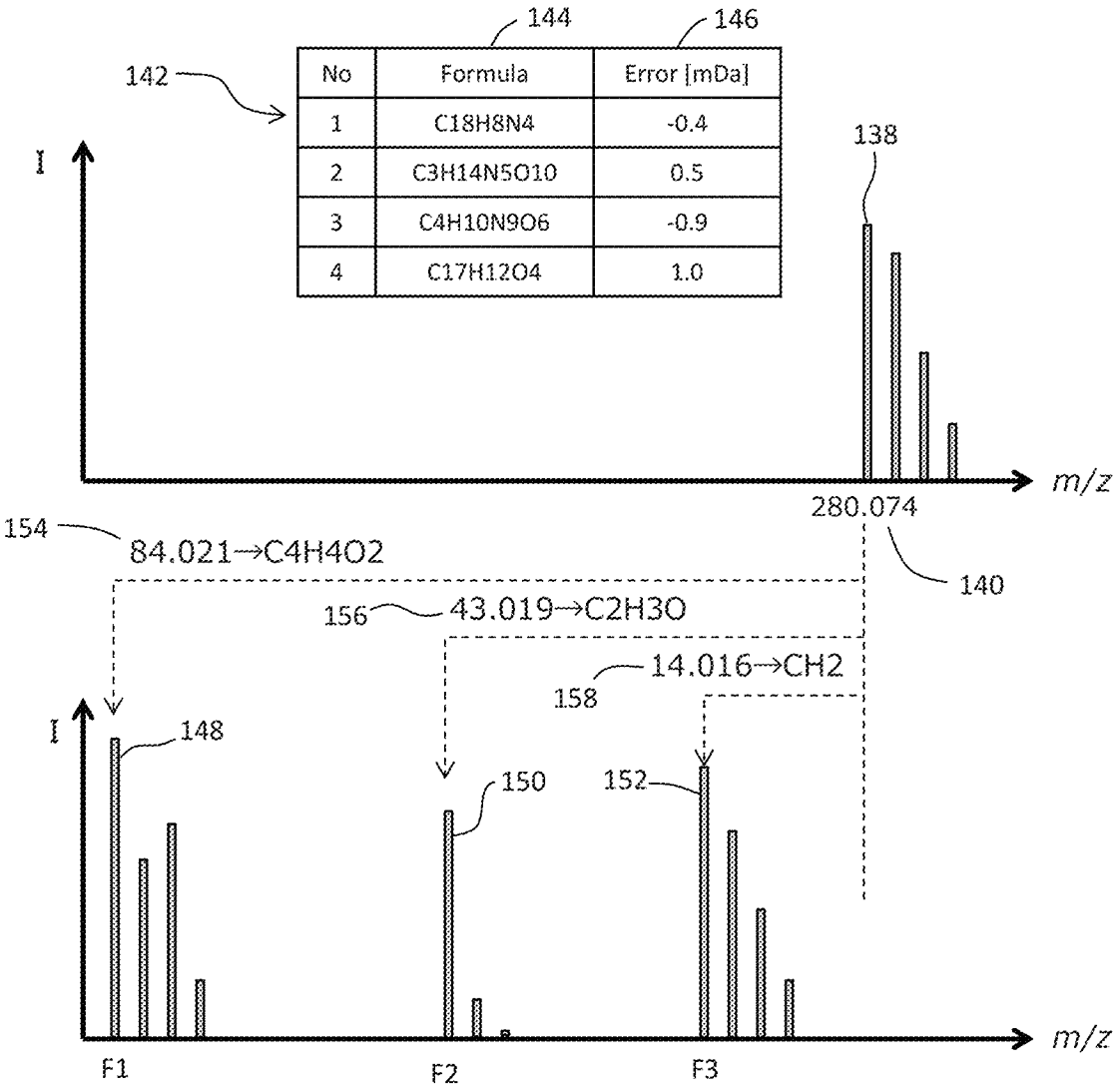
FIG. 13 is a diagram showing a calculation method of a partial composition.

In FIG. 13, the SI mass spectrum is shown at an upper part, and the EI mass spectrum is shown at a lower part. The SI mass spectrum includes a molecular ion peak group, and a mass 140 of a molecular ion peak 138 serving as the monoisotopic peak included in the molecular ion peak group is identified. A composition candidate list 142 is formed based on the mass 140. The composition candidate list 142 is formed from a plurality of records, each record including a composition formula 144 and an estimated error 146.

The EI mass spectrum includes a plurality of peak groups as a plurality of peak collections. Head peaks 148, 150, 152 of the respective peak groups correspond to the monoisotopic peaks. By subtracting each of the head peaks 148, 150, and 152 from the mass of the molecular ion peak 138, mass differences 154, 156, and 158 are calculated. From these mass differences 154, 156, and 158, a partial composition corresponding to the neutral loss is estimated.

Alternatively, the fragment ion peak group included in the EI mass spectrum may be referred to. Alternatively, the fragment composition may be directly estimated based on the mass identified from the fragment ion peak. However, with the above-described structure, an estimation precision of the fragment composition can be improved, or the number of fragment composition candidates can be narrowed down. An upper limit and a lower limit of a range for searching the fragment ion peak group may be set by the user or automatically.

FIG. 14 summarizes a result of the fragment process. Along a vertical axis, a plurality of composition candidates 164 are listed. Along a horizontal axis, a partial composition candidate 166, appropriateness/inappropriateness of the subtraction result 168, a result of isotope pattern comparison 170, and a result of evaluation 172 are shown.

In the illustrated example, for each composition candidate 164, three evaluations using three partial composition candidates 166 are performed. In the case in which the three partial composition candidates 166 are respectively subtracted from a composition candidate of interest, for example, when a number of oxygen atoms O or a number of carbon atoms C is negative, the combination of the composition candidate and the partial composition candidate is judged as inappropriate. In this case, the isotope pattern matching is not performed.

If the subtraction result is appropriate, pattern matching (third secondary pattern matching) is performed between the measured isotope pattern which is the fragment ion peak group, and the theoretical isotope pattern, and match/non-match is judged. In the illustrated example, match is judged for a combination shown with reference numeral 174, and a composition candidate corresponding thereto is evaluated as OK.

As described, according to the present embodiment, the isotope pattern matching can be correctly applied in a situation in which proton addition or hydrogen desorption may occur.

The invention claimed is:

1. A mass spectrometry system comprising:

a mass spectrometer;

a processor configured to process a first mass spectrum produced through soft ionization of a sample and a second mass spectrum produced through hard ionization of the sample, wherein:

the soft ionization is ionization in which a proton adding phenomenon may occur, the hard ionization is ionization in which a hydrogen desorbing phenomenon may occur, and the processor is further configured to:

estimate a composition of the sample based on at least one of a first mass corresponding to a first monoisotopic peak included in a first peak group in the first mass spectrum or a second mass corresponding to a second monoisotopic peak included in a second peak group in the second mass spectrum;

calculate a mass difference between the first mass and the second mass;

relatively shift one of the first peak group or the second peak group based on the mass difference;

attempt primary pattern matching between the first peak group and the second peak group after the one of the first peak group or the second peak group is relatively shifted; and attempt, when the primary pattern matching is successful, secondary pattern matching between a representative peak group which represents the first peak group and the second peak group, and an isotope pattern theoretically derived from the estimated composition, to thereby determine that the estimated composition is a correct composition of the sample.

2. The mass spectrometry system according to claim 1, wherein the processor is further configured to:

select, when the primary pattern matching is unsuccessful, a peak group, of the first peak group and the second peak group, having a higher likelihood of being a peak group derived from a single molecular ion species, as a peak group of interest; and attempt the secondary pattern matching between the peak group of interest selected by the selector and the isotope pattern theoretically derived from the estimated composition.

3. The mass spectrometry system according to claim 2, wherein the processor is further configured to:

calculate a first ratio based on an intensity of a head peak in the first peak group, and a sum of intensities of a plurality of succeeding peaks in the first peak group;

calculate a second ratio based on an intensity of a head peak in the second peak group, and a sum of intensities of a plurality of succeeding peaks in the second peak group; and select the peak group of interest by comparing the first ratio and the second ratio.

4. The mass spectrum processing apparatus according to claim 2, further comprising:

a fragment evaluator that evaluates, when the secondary pattern matching by the second secondary pattern matching unit is unsuccessful, the estimated composition based on a fragment ion peak group included in the first mass spectrum or the second mass spectrum.

5. The mass spectrum processing apparatus according to claim 4, wherein the fragment evaluator comprises:

a fragment composition estimator which estimates a fragment composition based on a monoisotopic peak in the fragment ion peak group; and a fragment pattern matching unit which attempts fragment pattern matching between the fragment ion peak group and a fragment isotope pattern theoretically derived from the fragment composition.

6. The mass spectrometry system according to claim 1, wherein the processor is further configured to:

attempt, when the second mass spectrum does not include the second peak group, pattern matching between the first peak group and the isotope pattern theoretically derived from the estimated composition.

7. The mass spectrum processing apparatus according to claim 6, further comprising:

a fragment evaluator that evaluates, when the pattern matching by the pattern matching unit is unsuccessful, the estimated composition based on a fragment ion peak group included in the first mass spectrum or the second mass spectrum.

8. The mass spectrum processing apparatus according to claim 7, wherein the fragment evaluator comprises:

a fragment composition estimator which estimates a fragment composition based on a monoisotopic peak in the fragment ion peak group; and a fragment pattern matching unit which attempts fragment pattern matching between the fragment ion peak group and a fragment isotope pattern theoretically derived from the fragment composition.

9. A method of performing mass spectrometry, comprising:

obtaining a first mass spectrum produced through soft ionization of a sample and a second mass spectrum produced through hard ionization of the sample using a mass spectrometer, wherein the soft ionization is ionization in which a proton adding phenomenon may occur, and wherein the hard ionization is ionization in which a hydrogen desorbing phenomenon may occur, processing the first mass spectrum and the second mass spectrum;

estimating a composition of the sample based on at least one of a first mass corresponding to a first monoisotopic peak included in a first peak group in the first mass spectrum or a second mass corresponding to a second monoisotopic peak included in a second peak group in the second mass spectrum;

calculating a mass difference between the first mass and the second mass;

relatively shifting one of the first peak group or the second peak group based on the mass difference;

evaluating the estimated composition by attempting primary pattern matching between the first peak group and the second peak group after the one of the first peak group or the second peak group is relatively shifted, and attempting secondary pattern matching between a measured isotope pattern which is the first peak group or the second peak group, and a theoretical isotope pattern theoretically derived from the estimated composition.

10. A non-transitory storage medium storing a program for processing a mass spectrum, the program comprising:

a function to process a first mass spectrum produced through soft ionization of a sample and a second mass spectrum produced through hard ionization of the sample, wherein the soft ionization is ionization in which a proton adding phenomenon may occur, and the hard ionization is ionization in which a hydrogen desorbing phenomenon may occur, a function to estimate a composition of the sample based on at least one of a first mass corresponding to a first monoisotopic peak included in a first peak group in the first mass spectrum or a second mass corresponding to a second monoisotopic peak included in a second peak group in the second mass spectrum; and a function to calculate a mass difference between the first mass and the second mass;

a function to relatively shift one of the first peak group or the second peak group based on the mass difference;

a function to determine that the estimated composition is an appropriate composition of the sample by attempting primary pattern matching between the first peak group and the second peak group after the one of the first peak group or the second peak group is relatively shifted, and attempting secondary pattern matching between a measured isotope pattern which is the first peak group or the second peak group, and a theoretical isotope pattern theoretically derived from the estimated composition.

* * * * *